US010462544B2

(12) United States Patent
Yan et al.

(10) Patent No.: US 10,462,544 B2
(45) Date of Patent: Oct. 29, 2019

(54) HYDROPHOBIC-COATED TRANSDUCER PORT WITH REDUCED OCCLUSION IMPACT

(71) Applicant: Apple Inc., Cupertino, CA (US)

(72) Inventors: Miaolei Yan, Santa Clara, CA (US); David MacNeil, Cupertino, CA (US); Michael K. Brown, Sunnyvale, CA (US); Richard Yeh, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/053,628

(22) Filed: Aug. 2, 2018

(65) Prior Publication Data

US 2019/0058934 A1 Feb. 21, 2019

Related U.S. Application Data

(60) Provisional application No. 62/547,054, filed on Aug. 17, 2017.

(51) Int. Cl.
*H04R 1/02* (2006.01)
*H04R 1/04* (2006.01)

(52) U.S. Cl.
CPC ..... *H04R 1/025* (2013.01); *H04R 1/04* (2013.01); *H04R 2201/02* (2013.01); *H04R 2499/11* (2013.01)

(58) Field of Classification Search
CPC ..... H04R 2201/02; H04R 2499/11; H04R 1/025; H04R 1/04
See application file for complete search history.

(56) References Cited

U.S. PATENT DOCUMENTS 10,136,232 B2 * 11/2018 Karamuk ..... H04R 25/654
2016/0277818 A1 * 9/2016 Jones ..... H04R 1/023
2017/0318404 A1 * 11/2017 Karamuk ..... H04R 25/604

FOREIGN PATENT DOCUMENTS

WO WO-2016058638 A1 * 4/2016 ..... H04R 25/654

* cited by examiner

*Primary Examiner* — Regina N Holder
(74) *Attorney, Agent, or Firm* — Morgan, Lewis & Bockius LLP

(57) ABSTRACT

A portable communication device includes a transducer enclosed in an enclosure. An opening allows flow of air between the transducer enclosed in the enclosure and a surrounding environment. The enclosure protects the transducer from misreading due to occlusion of environmental aggressors on the transducer. The enclosure is configured to repel the environmental aggressors away from a surface of the transducer and to keep a portion of the opening unclogged to maintain an air flow to the transducer.

20 Claims, 5 Drawing Sheets

HYDROPHOBIC-COATED TRANSDUCER PORT WITH REDUCED OCCLUSION IMPACT

CROSS-REFERENCE TO RELATED APPLICATIONS

This application claims the benefit of priority under 35 U.S.C. § 119 from U.S. Provisional Patent Application 62/547,054 filed Aug. 17, 2017, which is incorporated herein by reference in its entirety.

TECHNICAL FIELD

The present description relates generally to transducers, and more particularly, to a hydrophobic-coated transducer port with reduced occlusion impact.

BACKGROUND

Portable communication devices (e.g., smart phones and smart watches) are becoming increasingly waterproof by implementing electronic components inside sealed enclosures. However, certain components such as environmental (e.g., pressure, temperature and humidity) sensors, gas sensors, particulate matter (PM) sensors, speakers and microphones rely on physical interaction with the external environment for proper functionality. The physical interaction can be through a small opening provided on the enclosure. Exposure to the environmental aggressors such as fresh and salt water, skin oil, dust, sunscreens can cause a variety of system integration problems.

Port occlusion by water or debris is among the most severe problems, which can result in degradation in user experience, poor device reliability and/or device misreading. As an example, the accuracy of pressure sensors can be greatly reduced when residual water occludes the sensor surface, resulting in misreading to detect external pressure changes. As the water evaporates (which can take hours), false pressure-change signals can be detected. For example, when pressure is sensed for measuring height to count the number of stairs climbed by a user, the false pressure-change signals can indicate false or missed flight of stairs, which degrades the user experience.

BRIEF DESCRIPTION OF THE DRAWINGS

Certain features of the subject technology are set forth in the appended claims. However, for purposes of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced without one or more of the specific details. In some instances, structures and components are shown in block diagram form in order to avoid obscuring the concepts of the subject technology.

In one or more aspects, the subject technology is directed to a hydrophobic-coated (e.g., superhydrophobic-coated) transducer port that reduces occlusion impacts of environmental aggressors on functionalities of the transducer and the electronic device hosting the transducer. Exposing transducers to the environment while protecting them from occlusion misreading by environmental aggressors is a continuous challenge relevant to the integration of many environmental (e.g., pressure, temperature and humidity) sensors, gas sensors, particulate matter (PM) sensors, and potentially speakers and microphones in waterproofing systems. The subject technology enables addressing these challenges by achieving waterproofing and clogging prevention of electronic devices that require exposure to the environment. The disclosed solution can be applied to integrate electronic devices and components that operate based on being exposed to the environment such as pressure sensors, temperature and humidity sensors, gas sensors, particulate matter (PM) sensors, speakers and microphones in portable devices (e.g., potable communication devices such as smart phones and smart watches).

The subject technology can mitigate device degradation and misreading caused by port occlusion in contact with environmental aggressors such as fresh and salt water, skin oil, dust, sunscreens, and other environmental aggressors. The subject solution combines the application of hydrophobic-coatings with designs of port geometry to prevent water wetting and clogging and to facilitate rapid and complete clearing when wetting or clogging occurs. In some implementations, a superhydrophobic-coating can be used to achieve better results. The properties of the superhydrophobic-coatings are discussed in more below with respect to FIGS. 5 and 6. The subject technology can be utilized for integrating a variety of transducers that require exposure to the environment, such as pressure sensors, temperature and/or humidity sensors, gas sensors, particulate matter (PM) sensors, speakers and microphones into systems, such as smart phones and smart watches with improved waterproofing to achieve an enhanced user experience.

Figure 1:
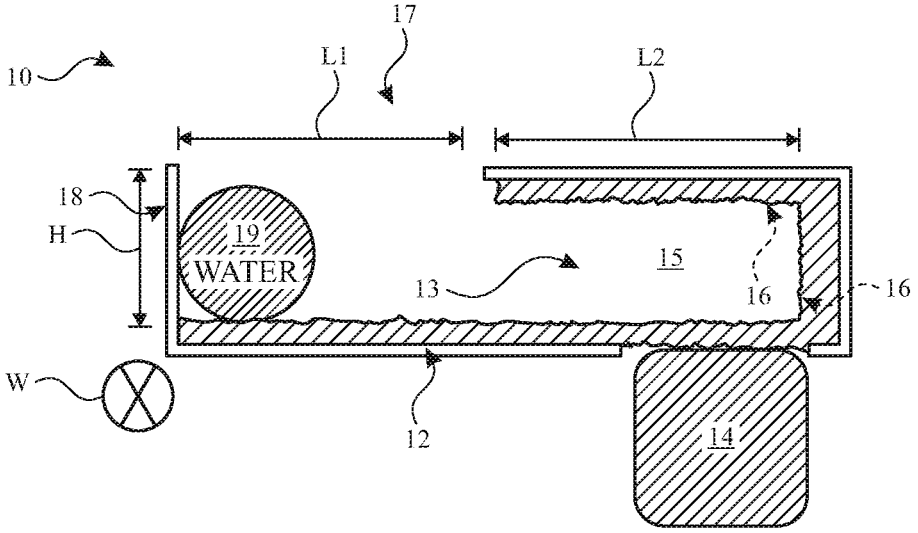
FIG. 1 is a schematic diagram illustrating an example of a hydrophobic-coated transducer port for a wet transducer, in accordance with one or more aspects of the subject technology.

FIG. 1 is a schematic diagram illustrating an example of a hydrophobic-coated transducer port 10 for a wet transducer 14, in accordance with one or more aspects of the subject technology. The transducer port 10 includes an enclosure 12 enclosing the wet transducer 14 (hereinafter "transducer 14"). The transducer 14 may be integrated with a host device such as a portable electronic device (e.g., a portable communication device such as a smart phone or a smart watch). In some implementations, the transducer 14 may be a miniature transducer, for example, a miniature microphone, a miniature speaker or a miniature sensor. The host device provides bias supply and signals (e.g., in case of a speaker) and process signals generated by the transducer 14 (e.g., in case of a microphone or a sensor). The miniature sensor may, for instance, be a miniature environmental sensor that can sense a gas or an environmental property such as pressure temperature or humidity. The transducer 14 is also referred to as a wet transducer because it is a waterproof transducer, which is made waterproof, for example, by applying a waterproofing coating (e.g., a waterproofing gel) on an active surface of the transducer.

In some implementations, the disclosed enclosures (e.g., enclosure 12) can be made of a ceramic, a metal such as stainless steel, aluminum, titanium or other suitable metals, alloys or compounds. The enclosure 12 may include a hydrophobic or a superhydrophobic (also referred to as "ultrahydrophobic") layer 16, which is formed (e.g., coated) on all surfaces of the cavity 15 of the enclosure 12 except for the sidewall 18, and an opening (also referred to as "vent") 17. The hydrophobic or superhydrophobic layer 16 (hereinafter "hydrophobic layer 16") can also be formed over the transducer 14 which is located at an offset from the opening 17. In some implementations, the hydrophobic layer 16 is not formed over the transducer 14. In one or more implementations, the transducer 14 can be inherently hydrophobic. Pre-treatment (e.g., removal of dirt, duct, oil and other particle) of the surfaces of the transducer port 10 before coating the hydrophobic layer 16 can be adopted to improve waterproofing and/or coating adhesion.

The transducer port 10 can keep environmental aggressors including water, oil and other environmental aggressors away from the surface (e.g., the active surface) of the transducer 14 by a gradient in the repellent properties of the hydrophobic layer 16 that is preferentially applied near the transducer 14. The hydrophobic layer 16 can be air permeable such that the air flow 13 can reach the transducer 14. Examples of the material for the hydrophobic layer 16 include silica nanoparticles and powdered oxides of rare earth metals that can be applied using, for example, with the known sol-gel technique. The sidewall 18 of the opening 17 is not covered with hydrophobic coating. In some implementations, a hydrophilic layer can be formed on the sidewall 18 of the opening 17. Commonly, the environmental aggressors include water or oil, and more frequently water. Thus, in the rest of the disclosure, water is used as an example of the environmental aggressors, for simplicity, but it is not intended to limit the applicability of the subject disclosure to water as the sole aggressor. When water (e.g., from immersion) enters through the opening 17, the hydrophobic layer 16 repels water droplets from surfaces near the transducer 14. These droplets finally accumulate into a drop 19 that can, for example, be attracted to the sidewall 18.

The geometry of the transducer port 10, including a width L1 of the opening 17, a height H of the sidewall 18 and a length L2 of the top side of the enclosure 12 can be optimized to achieve a desired repellent property for the transducer port 10. In some implementations, each of the width L1, the height H and the length L2 can be within a range of about tens of microns to few hundred microns. For example, the optimized width L1 is larger than a diameter of a typical drop (e.g., 19) to allow the air flow 13 into the enclosure and to the transducer 14 be maintained to prevent errors (e.g., misreading) by the transducer 14 (e.g., a gas sensor). In some implementations, the height H may be larger than a minimum liquid film thickness. The water drop 19 can be formed when the droplets are moved toward the sidewall 18 and accumulated. The water drop 19 can be evaporated or pushed out of the enclosure through the opening (vent) 17 by movements of the device (e.g., the smart phone or the smart watch) hosting the transducer 14. The geometry of the transducer port 10 may be deviate from the example shown in FIG. 1, for instance, the corners of the enclosure may be curved or the opening 17 may have extended out short walls not shown for simplicity.

An interesting feature of the transducer port 10 of the subject technology is that it protects the structural integrity of the hydrophobic layer 16, which is typically highly sensitive to mechanical touches or abrasion, by applying the hydrophobic layer 16 to the inner surfaces of the enclosure 12 to prevent abrasion, thus extending the lifetime of the coating. The transducer port 10 reduces accumulation of debris (e.g., oil such as body oil and sunscreen, dust, bacteria, and the like) near the transducer 14 by adopting the self-cleaning property of the hydrophobic layer 16. When small amount of water is present in the cavity 15, repulsion of water washes away the accumulated oil and dust, effectively cleaning the surface of the transducer 14 and the enclosure 12 of the transducer port 10.

Figure 2:
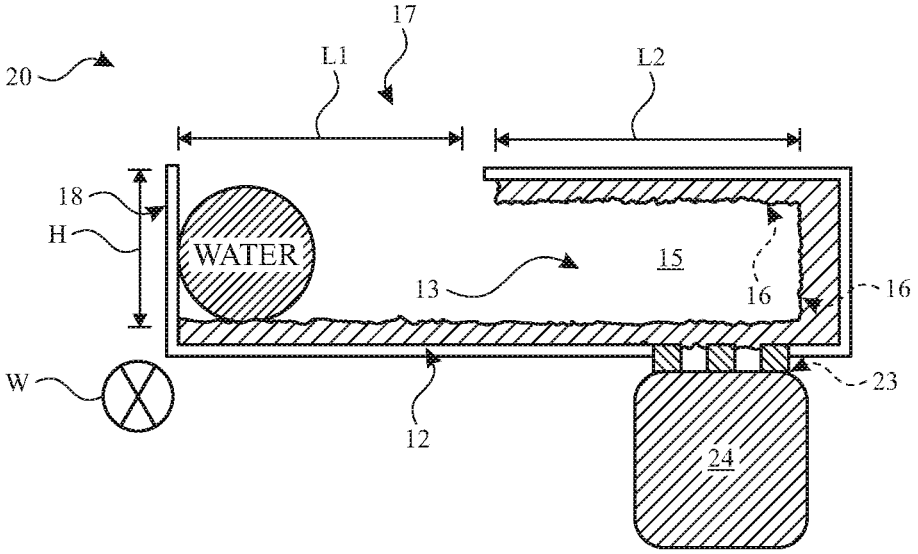
FIG. 2 is a schematic diagram illustrating an example of a hydrophobic-coated transducer port for a dry transducer, in accordance with one or more aspects of the subject technology.

FIG. 2 is a schematic diagram illustrating an example of a hydrophobic-coated transducer port 20 for a dry transducer 24, in accordance with one or more aspects of the subject technology. The hydrophobic-coated transducer port 20 (hereinafter "transducer port 20") is similar to the transducer port 10 of FIG. 1, except that the transducer 24 is a dry transducer (e.g., with no waterproofing coating) and is protected via an additional air permeable membrane 23 (hereinafter "membrane 23"). The membrane 23 can be a waterproofing membrane, which enables the use of the dry transducer 24 and allows signal (e.g., sound waves, in the case of a microphone or a speaker) transduction and air and/or gas diffusion (e.g., in the case of an environmental sensor), while preventing direct contact between the transducer 24 and the environmental aggressor (e.g., water). The hydrophobic layer 16 is optionally used over the membrane 23 and covers the internal sides of the cavity 15 except the sidewall 18, which can be coated with a hydrophilic layer. In some implementations, the membrane 23 can be inherently hydrophobic.

Figure 3:
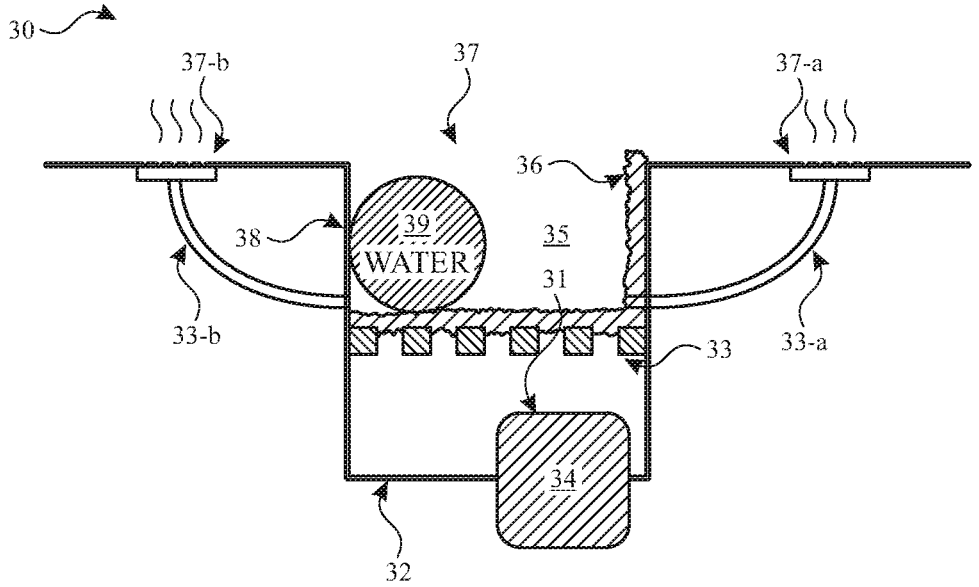
FIG. 3 is a schematic diagram illustrating an example of a hydrophobic-coated transducer port for a dry transducer, in accordance with one or more aspects of the subject technology.

FIG. 3 is a schematic diagram illustrating an example of a hydrophobic-coated transducer port 30 for a dry transducer 34, in accordance with one or more aspects of the subject technology. The transducer port 30 includes an enclosure 32 including the dry transducer 34 (hereinafter "transducer 34"), a membrane 33, and a hydrophobic or superhydrophobic layer 36 (hereinafter "hydrophobic layer 36"). In some implementations, the enclosure 32 is open from one side (e.g., the side facing the transducer 34) that forms the opening 37. The membrane 33 is a waterproof air permeable membrane and can be provided at a distance (e.g., within a range of about zero to a few millimeters) from the transducer 34. The membrane 33 enables the use of the dry transducer 34 and allows signal (e.g., sound waves, in the case of a microphone or a speaker) transduction and air and/or gas diffusion (e.g., in the case of an environmental sensor), while preventing direct contact between the transducer 34 and the environmental aggressor (e.g., water).

The hydrophobic layer 36 is formed (e.g., coated) over internal surfaces of the cavity 35, optionally including the top surface (not facing the transducer 34) of the membrane 33, except for the sidewall 38. In some implementations, the top surface of the membrane 23 can be inherently hydrophobic. Pre-treatment (e.g., removal of dirt, duct, oil and other particle) of the surfaces of the transducer port 30 before coating the hydrophobic layer 36 can be adopted to improve waterproofing and/or coating adhesion. In some implementations, the sidewall 38 can be coated with a hydrophilic layer where the water drop 39 can be attracted to. The opening 37 is sufficiently wide such that the water drop 39 cannot block a flow of air 31 through the membrane 33 into the transducer 34. The water drop 39 may be removed by movements of the device hosting the transducer port 30 or through evaporation. The water drop 39 may be formed by accumulation of small amount of water present in the cavity 35. The repulsion of the water drop 39 by the hydrophobic layer 36 can wash away the accumulated oil and dust, effectively cleaning the surface of the transducer 34 and the enclosure 32 of the transducer port 30.

In one or more implementations, one or more capillary channels (e.g., 33-*a* and 33-*b*) and can be added to transducer port 30, which can transfer water by capillary action, for example, from areas around the membrane 33 to one or more drying ports (or vents, e.g., 37-*a* and 37-*b*). From the drying ports, the water can be evaporated to help with pulling further water to the drying ports. In some implementations, internal walls of the channels can be coated with hydrophilic material to facilitate capillary movement.

Figure 4:
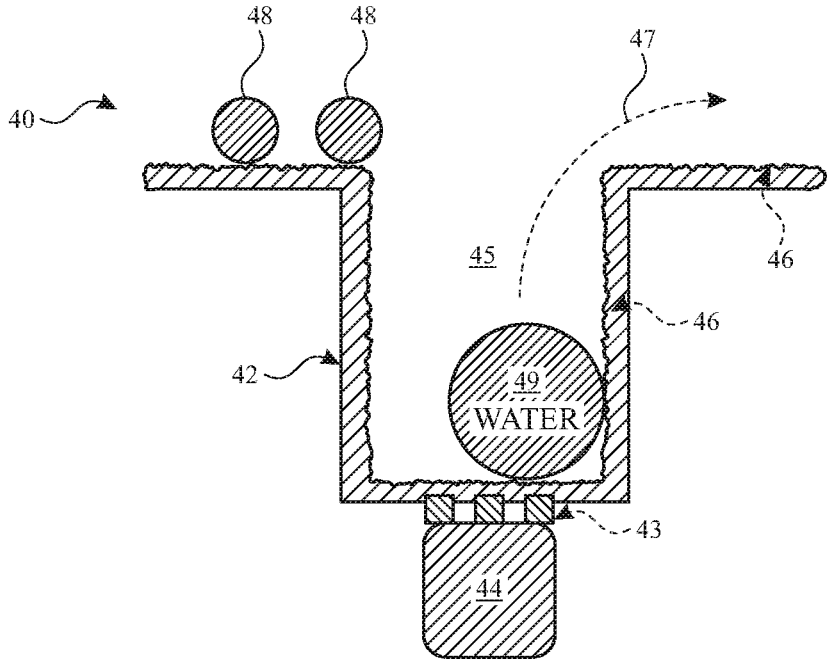
FIG. 4 is a schematic diagram illustrating an example of a hydrophobic-coated transducer port for a dry transducer, in accordance with one or more aspects of the subject technology.

FIG. 4 is a schematic diagram illustrating an example of a hydrophobic-coated transducer port 40 for a dry transducer 44, in accordance with one or more aspects of the subject technology. The hydrophobic (or superhydrophobic)-coated transducer port 40 (hereinafter "transducer port 40") includes an enclosure 42, a membrane 43, and a dry transducer 44 (hereinafter "transducer 44"). The enclosure 42 is open from one side facing the membrane 43. A hydrophobic or superhydrophobic layer 46 (hereinafter "hydrophobic layer 46") is formed non-preferentially over the entire surface of the transducer port 40 and optionally over the membrane 43. In some implementations, the membrane 43 can be inherently hydrophobic. Pre-treatment (e.g., removal of dirt, duct, oil and other particle) of the surfaces of the transducer port 40 before coating the hydrophobic layer 46 can be adopted to improve waterproofing and/or coating adhesion. The membrane 43 is an air permeable waterproof membrane and is provided over the transducer 44. Small water (or oil) droplets 48 may enter the cavity 45 and accumulate to form a water (or oil) drop 49, which can be removed by motion of the host device and unclog the transducer port 40, as depicted by the arrow 47. The repulsion of the droplets 48 and the drop 49 by the hydrophobic layer 46 can wash away the accumulated oil and dust, effectively cleaning the surface of the membrane 43 and the enclosure 4 of the transducer port 40. In some implementations, the capillary channels (e.g., e.g., 33-*a* and 33-*b*) of FIG. 3 can be similarly added to the transducer port 40.

Figure 5:
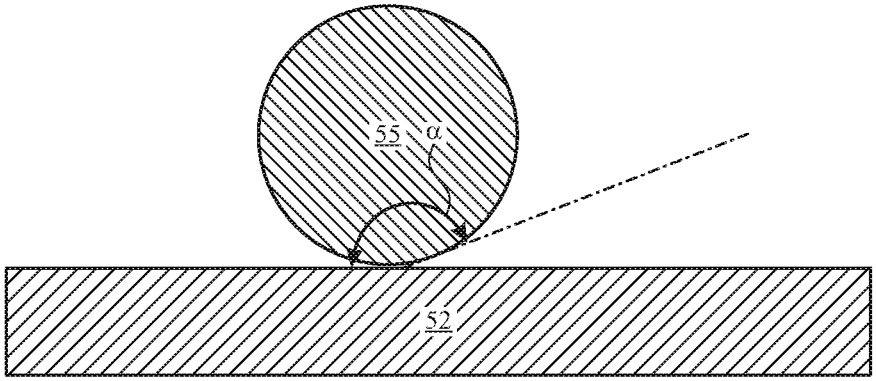
FIG. 5 is a schematic diagram illustrating an example of a superhydrophobic coated surface.

FIG. 5 is a schematic diagram illustrating an example of a superhydrophobic coated surface 52. By definition a superhydrophobic layer has a contact angle (e.g., $\alpha$) with water (e.g., water drop 55) that is larger than 150 degrees. Superhydrophobic coatings can be applied to a variety of different surfaces such as metals (e.g., aluminum, stainless steel, titanium, etc.) ceramics (e.g., concrete), wood, clothing fabrics and other surfaces. Compared with regular hydrophobic coatings, which rely on non-polar surfaces to repel water, superhydrophobic coatings have important characteristics such as low surface energy and surface micro-roughness. The superhydrophobic materials such as silica nanoparticles and powdered oxides of rare earth metals can have a superhydrophobicity property that is higher than most water repellent materials. Most superhydrophobic materials also have an oleophobic property that enables them to repel oils as well. The superhydrophobic layers typically have a self-cleaning property that prevents the accumulation of dust, human oil, bacteria on the layers. On surfaces coated with a superhydrophobic layer, small amount of water can wash away surface contaminants, effectively cleaning the surfaces.

Figure 6:
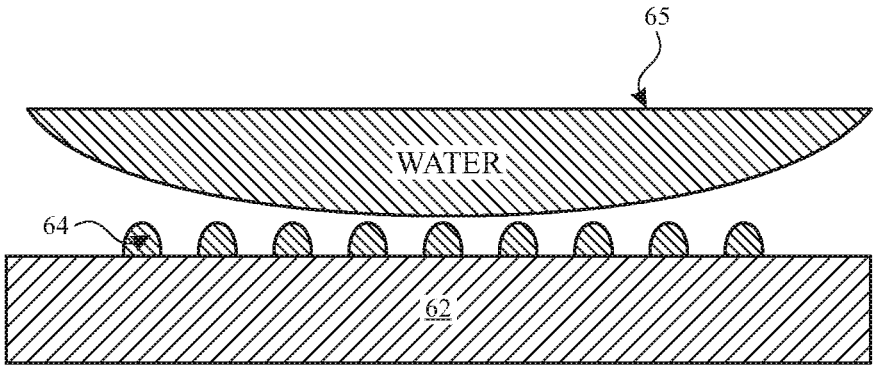
FIG. 6 is a schematic diagram illustrating another example of a superhydrophobic coated surface.

FIG. 6 is a schematic diagram illustrating another example of a superhydrophobic-coated surface 62. The superhydrophobic coated surface 62 includes a surface micro-roughness depicted by microstructures 64. The surface roughness ensures that air pockets are formed between the surface of a water droplet 65 and the coated surface 62. As seen from FIG. 6, the dimensions of the patterned microstructures 64 are substantially smaller than water droplet 65. It is to be noted that FIG. 6 is not drawn to scale, as the patterned microstructures 64 are on the order of tens to hundreds of microns, while the water droplet 65 could be on the order of millimeters or larger. Because of the microstructures 64, the superhydrophobic layers are structurally susceptible to wear and tear, as mechanical contact can damage the surface micro-roughness, causing the surface to at least partially lose its superhydrophobicity.

Figure 7:
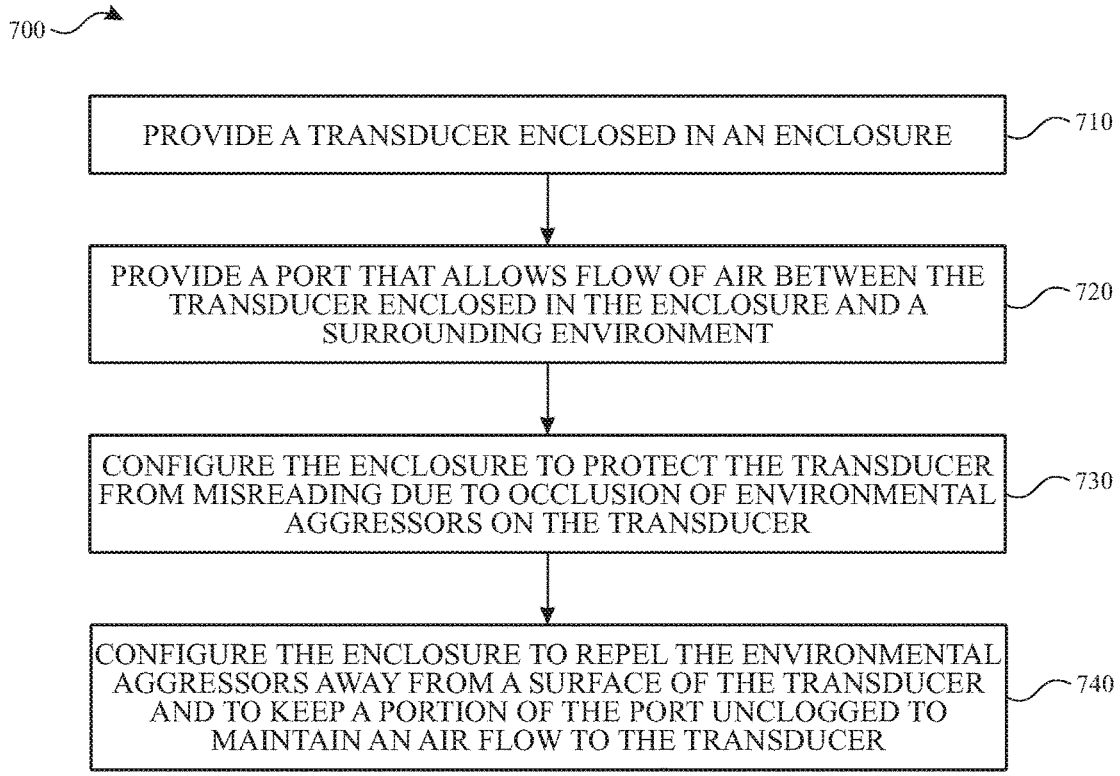
FIG. 7 is a flow diagram illustrating a method of providing of a hydrophobic-coated transducer port, in accordance with one or more aspects of the subject technology.

FIG. 7 is a flow diagram illustrating a method 700 of providing of a hydrophobic-coated transducer port (e.g., 30 of FIG. 1), in accordance with one or more aspects of the subject technology. The method 700 starts with providing a transducer (e.g., 14 of FIG. 1) enclosed in an enclosure (e.g., 12 of FIG. 1) (710). An opening (e.g., 17 of FIG. 1) is provided that allows flow of air between the transducer enclosed in the enclosure and a surrounding environment (720). The enclosure is configured to protect the transducer from misreading due to occlusion of environmental aggressors (e.g., 19 of FIG. 1) on the transducer (730). The enclosure is configured to repel the environmental aggressors away from a surface of the transducer and to keep a portion of the port unclogged to maintain an air flow (e.g., 13 of FIG. 1) to the transducer (740).

Figure 8:
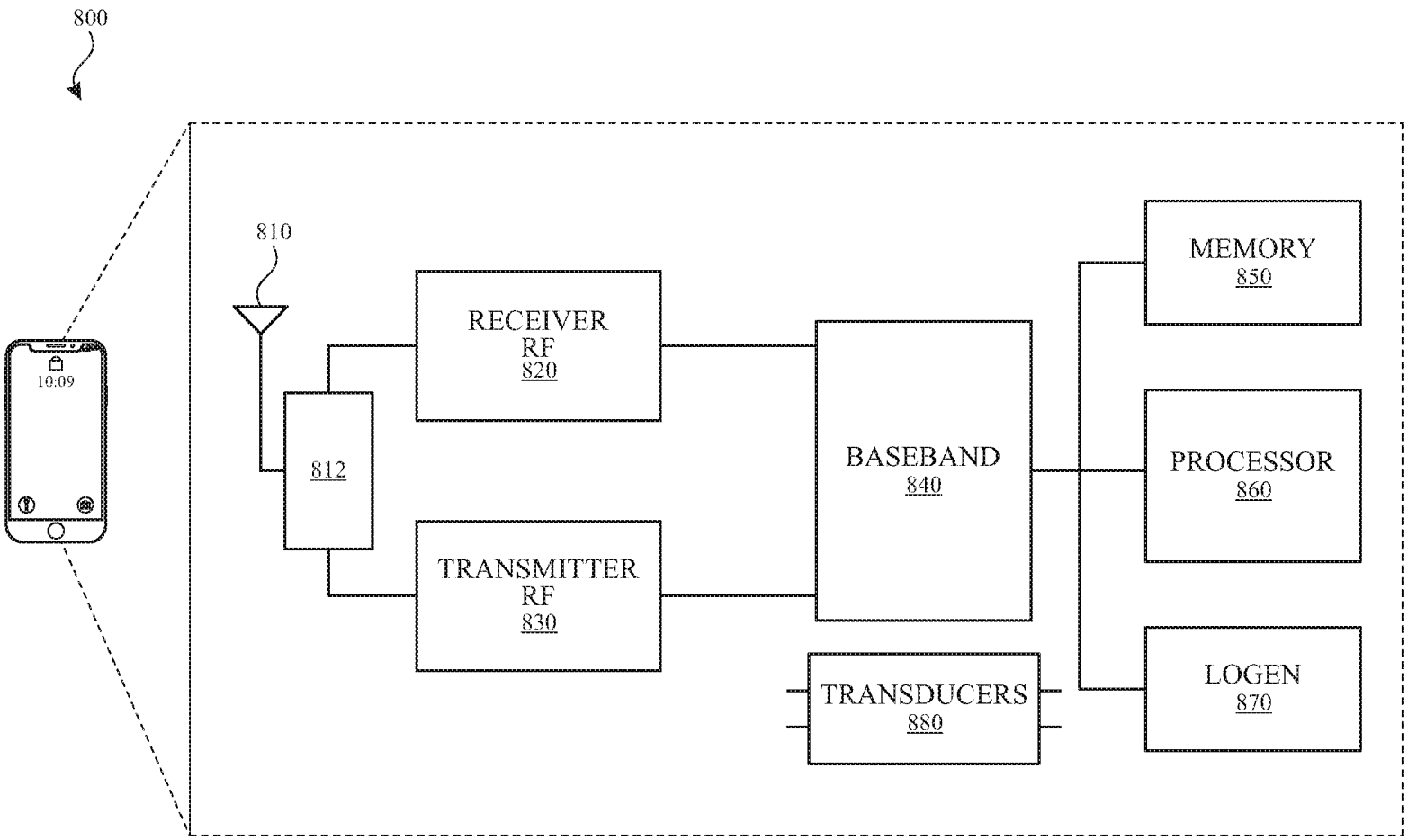
FIG. 8 is a block diagram illustrating an example wireless communication device, within which one or more miniature gas sensors of the subject technology can be integrated.

FIG. 8 is a block diagram illustrating an example wireless communication device, in which one or more miniature pressure sensors, humidity sensors, gas sensors or particulate matter (PM) of the subject technology can be implemented. The wireless communication device 800 may comprise a radio-frequency (RF) antenna 810, a receiver 820, a transmitter 830, a baseband processing module 840, a memory 850, a processor 860, a local oscillator generator (LOGEN) 870 and one or more transducers 880. In various embodiments of the subject technology, one or more of the blocks represented in FIG. 8 may be integrated on one or more semiconductor substrates. For example, the blocks 820-870 may be realized in a single chip or a single system on a chip, or may be realized in a multi-chip chipset.

The receiver 820 may comprise suitable logic circuitry and/or code that may be operable to receive and process signals from the RF antenna 810. The receiver 820 may, for example, be operable to amplify and/or down-convert received wireless signals. In various embodiments of the subject technology, the receiver 820 may be operable to cancel noise in received signals and may be linear over a wide range of frequencies. In this manner, the receiver 820 may be suitable for receiving signals in accordance with a variety of wireless standards, Wi-Fi, WiMAX, Bluetooth, and various cellular standards. In various embodiments of the subject technology, the receiver 820 may not require any SAW filters and few or no off-chip discrete components such as large capacitors and inductors.

The transmitter 830 may comprise suitable logic circuitry and/or code that may be operable to process and transmit signals from the RF antenna 810. The transmitter 830 may, for example, be operable to up-convert baseband signals to RF signals and amplify RF signals. In various embodiments of the subject technology, the transmitter 830 may be operable to up-convert and amplify baseband signals processed in accordance with a variety of wireless standards. Examples of such standards may include Wi-Fi, WiMAX, Bluetooth, and various cellular standards. In various embodiments of the subject technology, the transmitter 830 may be operable to provide signals for further amplification by one or more power amplifiers.

The duplexer 812 may provide isolation in the transmit band to avoid saturation of the receiver 820 or damaging parts of the receiver 820, and to relax one or more design requirements of the receiver 820. Furthermore, the duplexer 812 may attenuate the noise in the receive band. The duplexer may be operable in multiple frequency bands of various wireless standards.

The baseband processing module 840 may comprise suitable logic, circuitry, interfaces, and/or code that may be operable to perform processing of baseband signals. The baseband processing module 840 may, for example, analyze received signals and generate control and/or feedback signals for configuring various components of the wireless communication device 800, such as the receiver 820. The baseband processing module 840 may be operable to encode, decode, transcode, modulate, demodulate, encrypt, decrypt, scramble, descramble, and/or otherwise process data in accordance with one or more wireless standards.

The processor 860 may comprise suitable logic, circuitry, and/or code that may enable processing data and/or controlling operations of the wireless communication device 800. In this regard, the processor 860 may be enabled to provide control signals to various other portions of the wireless communication device 800. The processor 860 may also control transfers of data between various portions of the wireless communication device 800. Additionally, the processor 860 may enable implementation of an operating system or otherwise execute code to manage operations of the wireless communication device 800.

The memory 850 may comprise suitable logic, circuitry, and/or code that may enable storage of various types of information such as received data, generated data, code, and/or configuration information. The memory 850 may comprise, for example, RAM, ROM, flash, and/or magnetic storage. In various embodiment of the subject technology, information stored in the memory 850 may be utilized for configuring the receiver 820 and/or the baseband processing module 840.

The local oscillator generator (LOGEN) 870 may comprise suitable logic, circuitry, interfaces, and/or code that may be operable to generate one or more oscillating signals of one or more frequencies. The LOGEN 870 may be operable to generate digital and/or analog signals. In this manner, the LOGEN 870 may be operable to generate one or more clock signals and/or sinusoidal signals. Characteristics of the oscillating signals such as the frequency and duty cycle may be determined based on one or more control signals from, for example, the processor 860 and/or the baseband processing module 840.

In operation, the processor 860 may configure the various components of the wireless communication device 800 based on a wireless standard according to which it is desired to receive signals. Wireless signals may be received via the RF antenna 810 and amplified and down-converted by the receiver 820. The baseband processing module 840 may perform noise estimation and/or noise cancellation, decoding, and/or demodulation of the baseband signals. In this manner, information in the received signal may be recovered and utilized appropriately. For example, the information may be audio and/or video to be presented to a user of the wireless communication device, data to be stored to the memory 850, and/or information affecting and/or enabling operation of the wireless communication device 800. The baseband processing module 840 may modulate, encode, and perform other processing on audio, video, and/or control signals to be transmitted by the transmitter 830 in accordance with various wireless standards.

The one or more transducers 880 may include a speaker, a microphone or a miniature environmental sensor of the subject technology used in a transducer port as shown in FIGS. 1, 2, 3 and 4 and described above. The transcoder port of the subject technology can be readily integrated into the communication device 800, in particular when the communication device 800 is a smart mobile phone or a smart watch.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A transducer port device, the device comprising:

a transducer enclosed in an enclosure; and an opening configured to allow flow of air between the transducer enclosed in the enclosure and a surrounding environment, wherein:

the enclosure includes a coated layer formed on at least some internal surfaces of the enclosure, and the coated layer formed on the at least some internal surfaces of the enclosure has a gradient in repellent properties to keep a portion of the opening unclogged to maintain an air flow to the transducer.

2. The device of claim 1, wherein the layer comprises at least one of a hydrophobic or superhydrophobic layer that protects the transducer from misreading due to occlusion of environmental aggressors on the transducer.

3. The device of claim 1, wherein the transducer comprises a miniature transducer including a miniature sensor, microphone or speaker, wherein the miniature sensor comprises a microphone or a miniature environmental sensor configured to sense a gas, a particulate matter or an environmental property including a pressure, a temperature or a humidity.

4. The device of claim 2, wherein the environmental aggressors include at least one of water, oil or dust, and wherein the water includes fresh and salt water and the oil includes body oil or sunscreen.

5. The device of claim 1, wherein at least some surfaces of the enclosure in a close vicinity of the transducer include at least one of a hydrophobic or a superhydrophobic layer.

6. The device of claim 5, further comprising an air permeable membrane formed on an active surface of the transducer or at a distance from the surface of the transducer.

7. The device of claim 6, wherein at least one surface of the enclosure forming a wall of the opening includes no superhydrophobic layer or includes a hydrophilic layer.

8. The device of claim 6, wherein the at least one of the hydrophobic or the superhydrophobic layer is applied to at least one of the air permeable membrane that is coated on the active surface of the transducer or at the distance from the surface of the transducer.

9. The device of claim 8, further comprising channels configured to transfer water from an area around the air permeable membrane to one or more drying ports due to capillary action of water within the channels, and wherein the channels are coated with a hydrophilic layer.

10. The device of claim 8, wherein the at least one of the hydrophobic or the superhydrophobic layer is applied to entire exposed surfaces of the enclosure.

11. The device of claim 1, wherein a location of the opening on the enclosure is configured to be away from a direct view of the transducer in the enclosure.

12. A device comprising:

an enclosure including an opening; and a transducer enclosed in the enclosure, wherein:

the opening is configured to permit an air flow between the transducer enclosed in the enclosure and a surrounding environment, a location of the opening and dimensions of the enclosure are configured to maintain at least a portion of the opening away from a direct view of the transducer and a path for the air flow to the transducer unclogged in presence of environmental aggressors, and the enclosure includes at least one of a coated layer of hydrophobic or a superhydrophobic material on at least some surfaces of the enclosure.

13. The device of claim 12, wherein the at least one of the hydrophobic or the superhydrophobic material is formed on at least some surfaces of the enclosure in a close vicinity of the transducer.

14. The device of claim 12, wherein the enclosure includes at least one bare surface without the superhydrophobic material or including a hydrophilic layer, and wherein the bare surface comprises a wall of the opening.

15. The device of claim 12, further comprising an air permeable membrane formed on at least one of an active surface of the transducer or at a distance from the active surface of the transducer.

16. The device of claim 15, further comprising channels configured to transfer water from an area around the air permeable membrane to one or more drying ports due to capillary action of water within the channels, and wherein the channels are coated with a hydrophilic layer.

17. The device of claim 15, wherein the at least one of the hydrophobic or the superhydrophobic material is applied over the air permeable membrane.

18. A system comprising:

a communication device; and a miniature transducer integrated with the communication device, wherein:

the miniature transducer is being enclosed in an enclosure including an opening that is away from a direct view of the transducer, and at least some surfaces of the enclosure are coated with at least one of a hydrophobic or a superhydrophobic layer to protect the miniature transducer from misreading due to occlusion of environmental aggressors on the miniature transducer.

19. The system of claim 18, wherein the miniature transducer comprises a miniature transducer including a miniature environmental sensor, a microphone or a miniature speaker, and wherein the miniature environmental sensor is configured to sense a gas, a particulate matter or an environmental property including a pressure, a temperature or a humidity.

20. The system of claim 18, wherein the at least some surfaces of the enclosure comprise surfaces in a close vicinity of the miniature transducer, and wherein at least one surface of the enclosure forming a wall of the opening includes no superhydrophobic layer or includes a hydrophilic layer.

* * * * *